US007593292B2

(12) United States Patent
Blondeau et al.

(10) Patent No.: US 7,593,292 B2
(45) Date of Patent: Sep. 22, 2009

(54) SYNCHRONIZATION METHOD BETWEEN ANALOGUE DISPLAY MEANS AND THE TIME COUNTER OF A WATCH

(75) Inventors: Fabien Blondeau, Le Landeron (CH); Laurent Christe, Bienne (CH); Jérôme Cuenin, Trameian (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 100 days.

(21) Appl. No.: 11/427,882

(22) Filed: Jun. 30, 2006

(65) Prior Publication Data

US 2007/0002693 A1 Jan. 4, 2007

(30) Foreign Application Priority Data

Jul. 1, 2005 (EP) ..... 05106032

(51) Int. Cl.
*G04B 9/00* (2006.01)

(52) U.S. Cl. ..... 368/66; 368/204

(58) Field of Classification Search ..... 368/66, 368/204

See application file for complete search history.

(56) References Cited

U.S. PATENT DOCUMENTS 5,671,192 A 9/1997 Schaffel
6,144,622 A * 11/2000 Berney ..... 368/204

FOREIGN PATENT DOCUMENTS

DE 195 43 590 C1 1/1997
FR 2 671 646 A1 7/1992

OTHER PUBLICATIONS

European Search Report issued in corresponding application No. EP 05 10 6032 completed Feb. 14, 2006.

* cited by examiner

*Primary Examiner*—Renee S Luebke
*Assistant Examiner*—Jason Collins
(74) *Attorney, Agent, or Firm*—Griffin & Szipl, P.C.

(57) ABSTRACT

The invention concerns a synchronisation method between analogue display means (4, 6) and a volatile time counter (8) in a multi-function electronic watch when the primary powering means (18) powering said watch are replaced, including the following steps, (i) calculating a value (Vtps) representative of a time information item by means of the time base (14) of the watch; (ii) storing the value in the volatile time counter; (iii) updating the value in the volatile time counter periodically as a function of the supply frequency of a time information item by the time base; (iv) synchronised display of the value representative of a time information item by the analogue display means in a first operating mode of the watch; (v) non-synchronised display of a value not representative of a time information item by the analogue display means in a second operating mode of the watch; (vi) detecting the end of life of the primary power means powering the watch; (vii) setting the analogue display means in a predetermined reference position following detection of the end of life of the primary powering means; (viii) setting the value of the time counter to a predetermined reference value when the primary powering means are removed; (ix) automatic synchronisation between the analogue display means and the value of the time counter when the primary powering means are replaced.

7 Claims, 5 Drawing Sheets

PRIOR ART

TIME MODE

NON TIME RELATED MODE

TIME MODE

TIME MODE

TIME MODE

PRIOR ART

TIME MODE

NON TIME RELATED MODE

TIME MODE

TIME MODE

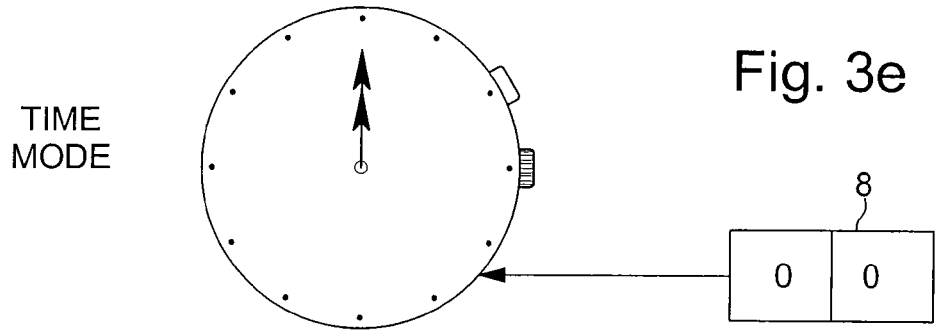
Fig. 3e
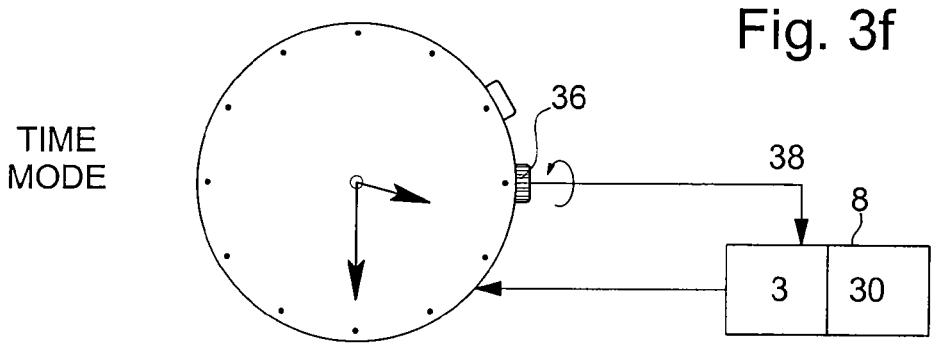
Fig. 3f
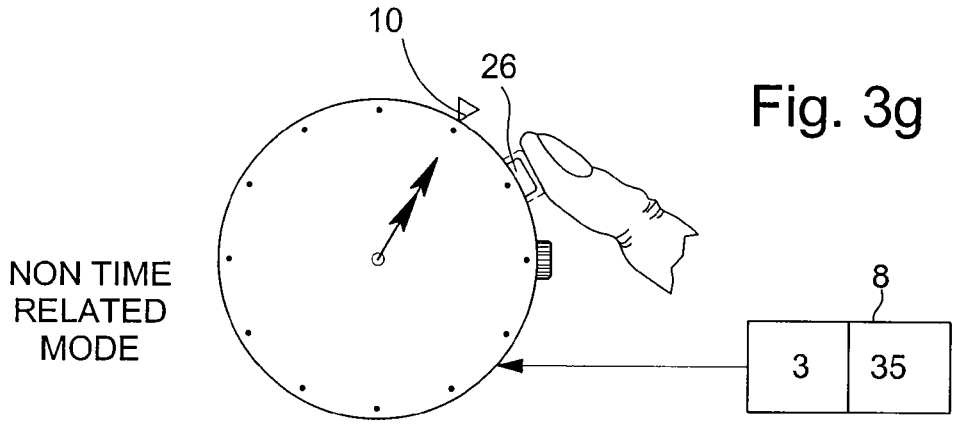
Fig. 3g
Fig. 4
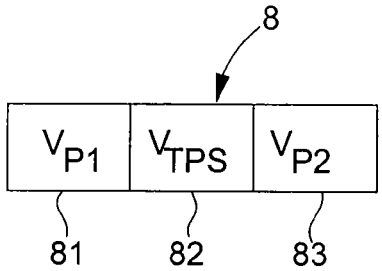

SYNCHRONIZATION METHOD BETWEEN ANALOGUE DISPLAY MEANS AND THE TIME COUNTER OF A WATCH

This application claims priority from European Patent Application No. 05106032.5, filed Jul. 1, 2005, the entire disclosure of which is incorporated herein by reference.

FIELD OF THE INVENTION

The present invention concerns, generally, a multi-function electronic watch powered by a non-rechargeable primary energy source including analogue display means operating in synchronism with a value representative of a time-related item of information contained in a volatile time counter whose value is calculated by means of a time base in a first operating mode of the watch, called the "time mode", and operating asynchronously with said value in a second operating mode of the watch, called the "non-time related mode". The invention concerns more specifically a simplified synchronisation method between the analogue display means and the value of the counter when the primary energy source is replaced.

BACKGROUND OF THE INVENTION

In the prior art, multi-function electronic watches are known that include a time base for calculating a value representative of a time-related item of information, namely the current time, a volatile time counter which stores the calculated value representative of the current time and the position of the analogue display means, namely the hands, operating in synchronism with this calculated value in a first operating mode, called the "time mode", and operating in an asynchronous manner with the calculated value in a second "non-time-related" mode, like for example a chronograph mode, a compass mode or even a weather mode.

For obvious reasons of cost and available space in such multi-function watches, it is preferable to power the watch by means of a primary energy source. However, at the end of the life of such a primary energy source, on the one hand, the hands are stopped when the energy provided by the source is perceived to be insufficient to move them, and, on the other hand, the value of the counter is corrupted when the source is insufficient to power the time counter and zero reset when the primary energy source is replaced. Thus, after the primary energy source has been replaced, the value contained in the time counter no longer corresponds to the value corresponding to the position in which the hands were or have been stopped. In cases where the user resets the time after replacing the primary energy source, as the hands operate in synchronism with the time counter value, the shift between the position of the hands and the value contained in the time counter remains. Although this shift in no way prevents the watch from operating normally in its time mode, this raises a problem when the user wishes to use the non-time related mode of the watch. Indeed, in the non-time related mode, the watch is supposed to place the hands in a reference position which it determines as a function of the value contained in the time counter, which is supposed to match the actual position of the hands. Thus, the hands are brought into incorrect positions in the non-time related mode, which causes the user to think that the watch is defective which is evidently undesirable.

One example of this malfunction is detailed in relation to FIGS. 1*a* to 1*h*. In this example, each hand is moved by means of an independent motor.

FIG. 1*a* shows, in time mode, dial 2 of the watch on which hands 4 and 6 indicate the current time, namely 10 minutes past 10 o'clock, in synchronism with the value contained in the time counter 8 of the watch.

FIG. 1*b* shows the same watch five minutes later, in non-time related mode, the latter being activated by the user. In this non-time related mode, hands 4 and 6 indicate a predetermined reference value, i.e. here both hands point towards the first indicator corresponding to 1 o'clock or 5 minutes, an additional indicator 10 being able to be arranged opposite on the bezel (not shown), or even on the dial or the crystal. Thus, the user knows that he is in the non-time related mode corresponding to indicator 10, the hands pointing in that direction. The correct positioning of the hands can be achieved simply by moving the hands independently of each other by means of their respective motor, since the electronic circuits of the watch know the start position of the hands defined by the value in the time counter, both being synchronous and the end position of the hands, the latter being predetermined for the non-time related mode selected. During operation in the non-time related mode, the value of the counter continues to be incremented by the time base, with the hands no longer being in synchronism with said value.

In FIG. 1*c*, the watch has returned to time mode, either because the user has activated the time mode, or because the watch has automatically returned to the time mode after, for example, a timeout. The time indicated by hands 4 and 6 is now 20 minutes past 10 o'clock.

In FIG. 1*d*, the power supplied by the primary energy source of the watch has become insufficient to move hands 4 and 6, which, in the example shown, continue to indicate 20 minutes past 10 o'clock, whereas the value contained in the time counter may continue to be incremented, this updating of the counter value consuming less energy.

FIG. 1*e* shows either the state of the watch at the end of life of the energy source, or just after the energy source has been replaced. In the first case, the time counter is not longer being powered and the value that it contains is corrupted (reset to zero), the hands still indicating 20 minutes past 10 o'clock. The user is then aware that he has to change the energy source when he sees the hands have stopped, which brings us to the second case following the replacement of the energy source. In the second case, the counter value is reset to zero, or any other constant pre-set value, the powering of the counter having been interrupted for a relatively long time period, following replacement of the energy source. In the example shown, as the replacement has just occurred, the hands still indicate 20 minutes past 10 o'clock. It will thus be noted that there is a shift between the value contained in the time counter and the value corresponding to the real position of the hands.

Following the replacement of the energy source, as is shown in FIG. 1*f*, the user has reset the time of the watch, for example in a conventional manner by means of a time setting crown. It should be noted that in the time reset operating mode of the watch, when the hands are driven, the value contained in the counter can be altered in synchronism (8*a*) with the movement of the hands or remain unchanged (not shown). In the example shown, the current time is 15 hours and 30 minutes. The user must thus rotate the hands by 5 hours and 10 minutes to bring them into a position where the correctly indicate the current time. In the first case where the counter (8*a*) remains synchronised during time resetting, the value that it contains is then 5 hours 10 minutes. In the second case (not shown) where the counter is not synchronised with the hands when the time is reset, the value that it contains remains unchanged, namely 0 hours and 0 minutes. Thus in both cases, there is still a shift between the value contained in the counter and the value corresponding to the real position of the hands.

FIG. 1*g* shows the position of the hands on the dial in the case presented in FIG. 1*f*, i.e. when the value contained in the counter can be altered in synchronism, when the user again activates the non-time related mode. In the example shown, the user has activated the non-time related mode 5 minutes after having replaced the energy source. The value contained in the counter is thus, 5 hours and 15 minutes (counter 8*a*), when the value contained in the counter can be altered in synchronism. Figure h shows the same situation as FIG. 1*g* for the case when the value contained in the counter remains unchanged: the value of the counter 8*b* will then be 0 hours and 5 minutes.

In the first case (FIG. 1*g*), hour hand 4*a* is shifted by 4 hours and 15 minutes in the anti-clockwise direction. This value of 4 hours 15 minutes is obtained by taking the difference between the value contained in the counter 8*a*, namely in this example 5 hours 15 minutes, and the predetermined reference position of hour hand 4*a* in the non-time related mode, namely in this example 1 o'clock. In the knowledge that, in the example concerned, hour hand 4*a* is initially between the 3 and 4 o'clock indicators, the movement of 4 hours 15 minutes brings the latter to point between the indicators corresponding to 11 and 12 o'clock. The minute hand 6*a* is shifted 10 minutes in the anti-clockwise direction. This value of 10 minutes is obtained by taking the difference between the value corresponding to the minutes contained in counter 8*a*, namely 15 minutes in this example, and the predetermined reference position of minute hand 6*a* in the non-time related mode, namely 5 minutes in this example. In the knowledge that, in the example being considered, minute hand 6*a* is initially pointing to 35 minutes, the movement of 10 minutes brings the latter opposite the indicator corresponding to 25 minutes. It will thus be observed that the hands of the watch each indicate a "fantasy" value instead of indicating the desired reference position for informing the user that the time mode has been selected. The user can thus quite rightly think that his watch is not working properly.

In the second case (FIG. 1*h*), the same calculation rules are applied and because of the shift between the real position of hands 4*b* and 6*b* and the value that is supposed to correspond in counter 8*b*, a "fantasy" result is also obtained. Thus, again the hands are not pointing in the direction of the desired reference position when the non-time related mode is activated by the user, who might thus doubt that his watch is working properly in this mode.

In order to avoid this shift between the real position of the hands and the value representative of this position in a counter, certain solutions of the prior art provide for the use of a non-volatile memory for storing the position of the hands. Thus, even in the event of a prolonged interruption to the power supply, due for example to replacement of the watch battery, the value corresponding to the position of the hands is maintained and thus actually corresponds to the real position of the hands. However, this solution is not desirable for evident reasons of manufacturing costs, and available space in the printed circuit of the watch.

SUMMARY OF THE INVENTION

It is one of the main objects of the present invention to overcome the aforementioned drawbacks by implementing a synchronisation method between the analogue display means of the watch and the corresponding value stored in a volatile time counter for keeping the two matching in particular when the primary energy source of the watch is replaced.

Thus, within the scope of the present invention, there is provided a synchronisation method including the following steps:

- calculation of a value representative of a time related item of information by means of a time base of the watch;
- storage of said value in said volatile time counter;
- updating said value in said volatile time counter periodically as a function of the supply frequency of a time related item of information by said time base;
- synchronised display of the value representative of a time related information item by the analogue display means in a first operating mode of said watch;
- non-synchronised display of a value that is not representative of a time related information item by the analogue display means in a second operating mode of said watch;
- detection of the end of life of said primary powering means powering said watch;
- setting the analogue display means in a predetermined reference position following detection of the end of life of the primary powering means;
- setting to a predetermined reference value of the time counter when primary powering means are removed.
- automatic synchronisation between the analogue display means and the value of the time counter when the primary powering means are replaced.

Advantageous implementations of the method are described in the dependent claims 2 to 6.

According to another aspect, the present invention also concerns a multi-function electronic watch capable of implementing the aforementioned synchronisation method. This watch includes:

- a time base for calculating a value representative of a time-related information item;
- a volatile time counter in which said calculated value is stored;
- analogue display means;
- a first operating mode wherein the analogue display means are synchronous with the time counter value;
- a second operating mode wherein the analogue display means are asynchronous with the time counter value;
- primary powering means for the electronic circuits of the watch,
- means for detecting the end of life of the primary powering means, characterized in that the watch is further arranged for positioning the analogue display means in a predetermined reference position following detection of the end of life of the primary powering means, and for resetting the time counter value to zero when the primary powering means are replaced.

BRIEF DESCRIPTION OF THE DRAWINGS

Other features and advantages of the present invention will appear more clearly upon reading the following detailed description of embodiments of the invention given solely by way of non-limiting example and illustrated by the annexed drawings, in which:

FIGS. 3*a* to 3*g* show the evolution of the analogue display means and the time counter value of a multi-function electronic watch according to the invention, in particular, when the battery is being replaced;

FIG. 4 shows a time counter used in accordance with a preferred implementation of the synchronisation method according to the invention.

DETAILED DESCRIPTION OF THE INVENTION

Figure 2:
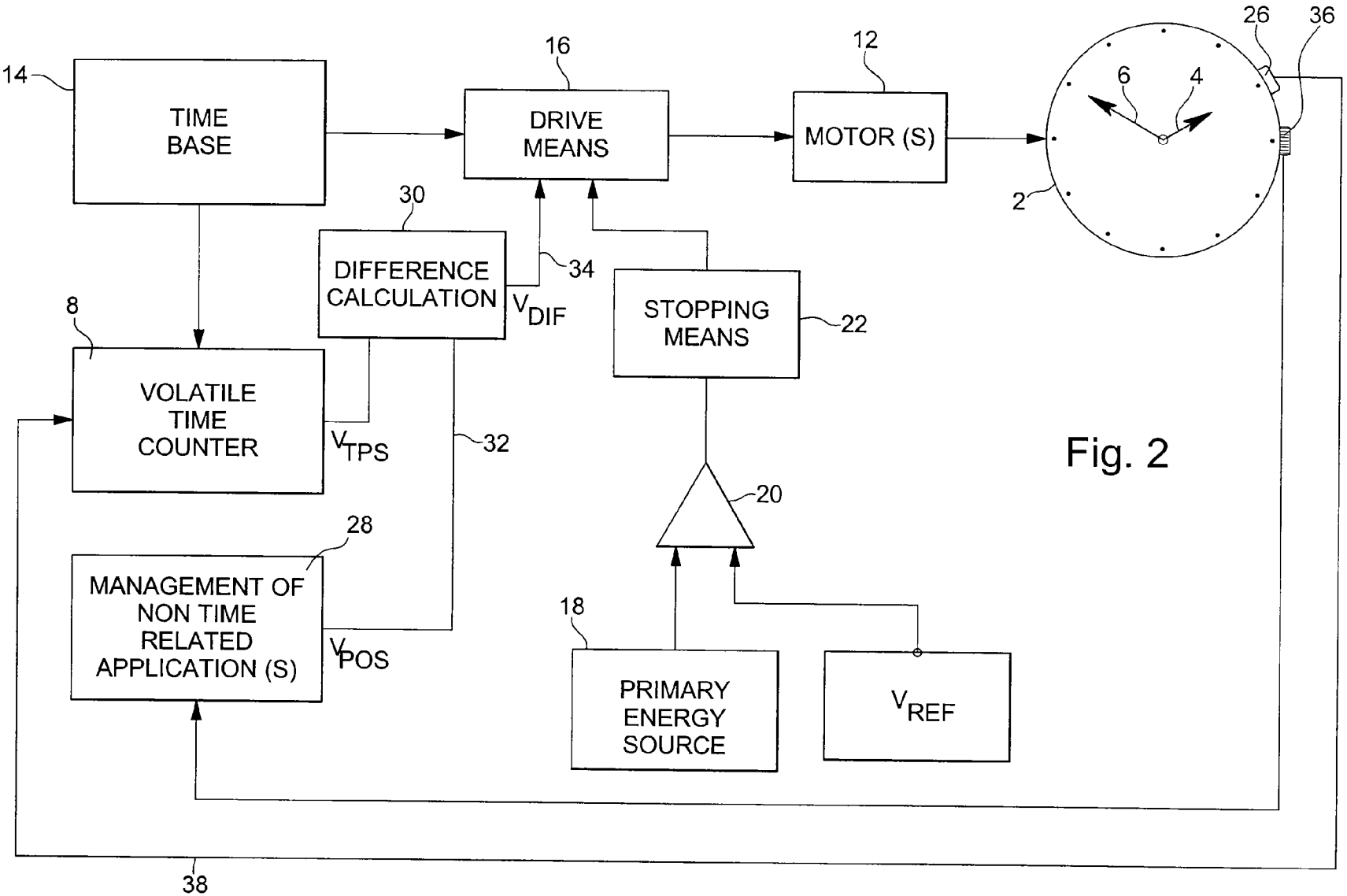
FIG. 2 shows schematically a multi-function electronic watch according to the present invention.

The following description is provided solely by way of example, in particular, FIG. 2, which shows the elements of the watch necessary for comprehension of the implementation of the synchronisation method according to the invention. The electronic watch includes analogue display means generally including at least two hands 4 and 6 arranged above a dial 2, one of the hands 4 being used to indicate the hours and the other 6 the minutes in the time mode of the watch. It is of course possible to provide other hands, such as for example a third hand (not shown) for indicating the seconds. Hands 4 and 6 are driven by at least one motor 12. Preferably, one stepping motor is used for driving each of the hands, which enables non-time related information to be provided, like for example superposing the two hands opposite an indicator offset in relation to 12 o'clock. The arrangement of the motors and gear trains for driving the hands will not be described here. Indeed, watch movements comprising several motors for individually activating several hands are well know to those skilled in the art.

For each motor 12 a time base 14 defines the step for advancing the hand associated with said motor. The time base generally used is formed, in particular, of a quartz oscillator and various frequency divider stages of the oscillator for driving each motor with the desired step. Drive means 16 for the motor or motors 12 are provided for this purpose.

The motor or motors 12 are powered by a non-rechargeable primary power source 18. A voltage comparator 20 is arranged at the output of power source 18. This comparator 20 receives the supply voltage Valim at a first input and a reference voltage Vre at a second input for comparing the supply voltage Valim to said reference voltage Vref. This reference voltage Vref is chosen such that if the supply voltage is higher than or equal to the reference voltage (Valim≧Vref), then the electronic circuits of the watch and the analogue display operate properly. Conversely, if the supply voltage is lower than the reference voltage (Valim<Vref), then the electronic circuits of the watch and especially the working of the hands are no longer guaranteed to operate properly. The result of the comparison is transmitted to stopping means 22 which, in the latter case where the supply voltage is insufficient to allow the watch to operate properly, cause the drive means of motor 16 to stop then to position hands 4 and 6 in a reference position so as to warn the user that the power source 18 is insufficient and that it therefore needs to be replaced. The reference position in which the hands are placed is preferably 12 o'clock.

A time-keeper circuit includes in particular a volatile time counter 8 which counts the time according to the pulses received by time base 14. In the time mode of the watch, the time value contained in counter 8 corresponds to an indication of the position of the hands, the latter then operating in synchronism with that value.

The watch, within the scope of the present invention, is a multi-function watch including at least one non-time related mode in addition to the time mode. In the non-time related mode, hands 4 and 6 provide a non-time related information item which is no longer in synchronism with the time value contained in counter 8. The watch includes means 26 for selecting this non-time related mode, which can be implemented for example in the form of a control member such as a push button. However, it should be noted that other types of selection means could be implemented, like for example a touch type glass, or automatic trigger as a function of a measurement made by a sensor of the watch. Following activation of selection means 26 of the watch, the latter switches from the time mode to a non-time related mode or vice versa depending upon the mode in which it was previously. In the case of passage from time mode to non-time related mode, the electronic part managing the non-time related application or applications is activated. Depending upon the non-time related mode selected by the user, the application control means 28 send a signal 32 to difference calculating means 30, corresponding to a reference value in which the hands have to be placed to indicate to the user that the desired mode has been selected. Thus, difference calculating means 30 receive, on the one hand, a reference value (Vpos) originating from the non-time related application control means 28, and on the other hand the time value (Vtps) contained in time counter 8. The result of the difference calculated by difference calculating means 30 enables a control signal 34 to be sent to the motor drive means 16 to move the hands from their current position to the reference position indicating the selected non-time related mode. Conversely, in the case of passage from a non-time related mode to time mode, difference calculating means 30 provides a control signal 34 to the hand drive means to move the hands from a reference position indicating the previously selected non-time related mode to a position corresponding to time information matching the time value contained in counter 8.

It should be noted that if the watch includes several non-time related modes, it is possible for the user to select one non-time related mode while the watch is in another non-time related mode. In such case, difference calculating means 30 receives two signals corresponding on the one hand to the reference position of the current non-time related mode (Vpos1), and on the other hand, to the reference position of the newly selected non-time related mode (Vpos2). The results of the difference (Vdif) thus enables passage directly from one reference position of the two non-time related applications to the other.

As was seen previously, the hands are automatically placed in a predetermined reference position when the supply voltage supplied by power source 18 is insufficient for the watch to operate properly. Thus, the user is warned of the need to replace the power source. As time counter 8 is of the volatile type, removal of the power source resets the time value that it contains to a predetermined reference value, for example to zero. After replacement of power source 18, the watch again operates correctly and the time value (here 0) contained in counter 8 actually matches the actual position of the hands which have been placed in the 12 o'clock reference position. If the predetermined reference position is offset in relation to 12 o'clock, the electronic circuits of the watch, which know of this shift, can adequately increment the time value of the counter such that the time value is representative of the actual position of the hands in time mode upon reset resulting from the replacement of the power source. When the actual position of the hands, i.e. the predetermined reference position in which they have been placed, does not match the current time, following replacement of the power source, which occurs in most cases, the user can then reset the time, for example by means of a conventional mechanism activated by a winding crown 36. In this time-reset mode, it is important for hands 4 and 6 to operate in synchronism with the time value of counter 8. For this purpose the time reset mechanism transmits a hand movement signal 38 to time counter 8, which can then update the time value so that this value is always representative of the real position of the hands in the time mode.

FIGS. 3*a* to 3*g* show an example implementation of the synchronisation method according to the present invention.

Figure 3A:
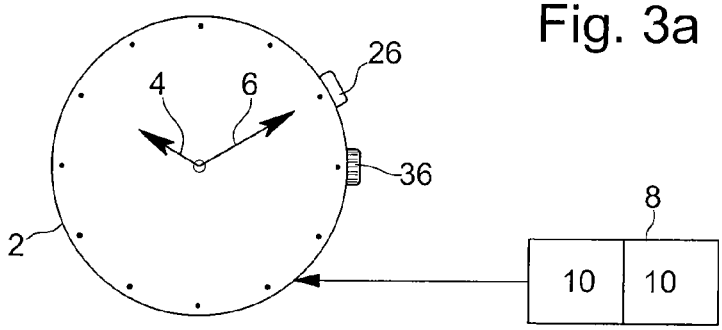

FIG. 3*a* shows, in time mode, watch dial 2 on which hands 4 and 6 are indicating the current time, namely 10 minutes past 10, in synchronism with the value contained in time counter 8 of the watch.

Figure 3B:
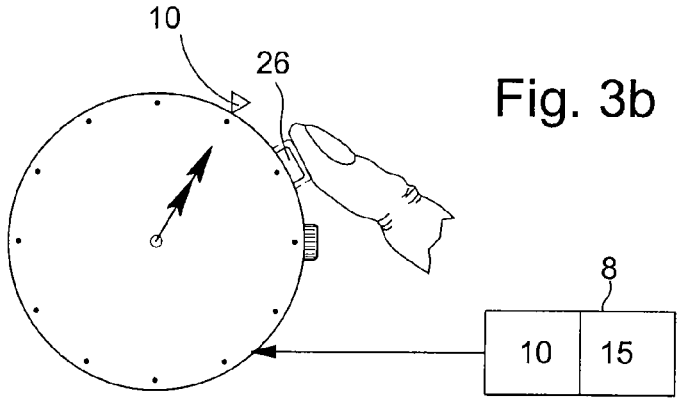

FIG. 3*b* shows the same watch five minutes later, following activation of control member 26 by the user to select a non-time related mode of the watch. In this non-time related mode, hands 4 and 6 indicate a predetermined reference value, i.e. here both hands are pointing towards the first indicator of the dial corresponding to 1 o'clock or 5 minutes, an additional indicator 10 being able to be arranged facing the bezel (not shown) or even on the dial or the crystal. Thus, the user knows that the watch is in the non-time related mode corresponding to indicator 10, since the hands are pointing in that direction. The correct position of the hands can be achieved simply by moving the hands independently of each other by means of their respective motor, since the electronic circuit of the watch knows the start position of the hands defined by the value in the time counter, both being synchronous and the end position of the hands, the latter being predetermined for the selected non-time related mode. During operation in non-time related mode, the value of the counter continues to be incremented by the time base, with the hands no longer being in synchronism with said value.

Figure 3C:
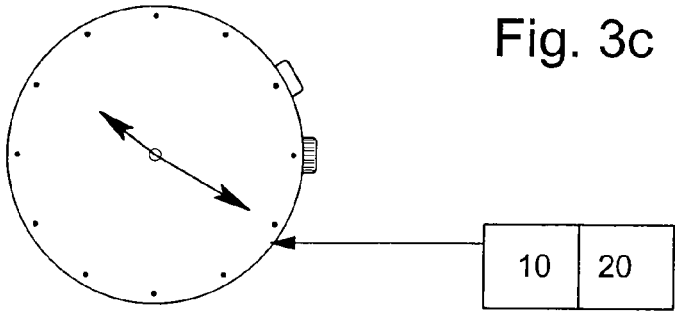

In FIG. 3*c* the watch has returned to time mode, either because the user has activated the return to time mode, or because the watch has automatically returned to time mode after, for example, a timeout. The time indicated by hands 4 and 6 is now 20 minutes past 10. The corresponding value is contained in time counter 8.

Figure 3D:
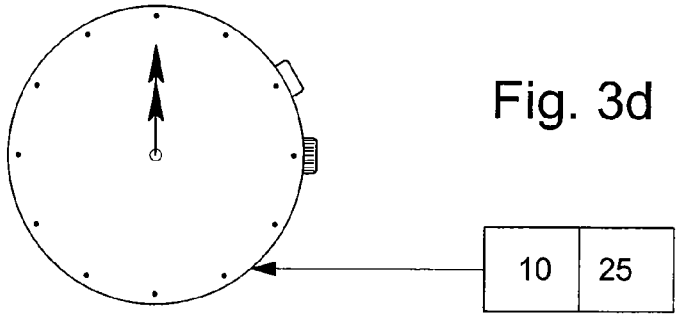

In FIG. 3*d*, the supply voltage provided by the primary power source has become insufficient to allow the watch to operate properly and particularly to ensure that the hands advance correctly, i.e. in synchronism with the time value of counter 8. This is why, within the scope of the present invention, the supply voltage (Valim) is compared to a reference voltage (Vref). When the supply voltage is less than the reference voltage, the hands are then positioned in a predetermined reference position, for example 12 o'clock, then the means for stopping the motor drive means are activated so a to block the hands in said predetermined reference position. Thus, the user is warned that there is insufficient power and knows that he must replace the power source. The counter may or may not continue to be incremented.

FIG. 3*e* shows the watch following replacement of the power source. As the counter is a volatile memory, the value that it contains has been reset to zero during the prolonged power interruption due to replacement of the power supply. Thus, the counter value is again representative of the position of the hands in time mode. It will be noted that if the predetermined reference position is chosen to be offset in relation to 12 o'clock, this is not inconvenient provided the shift between the counter value and the real position of the hands is defined and thus known to the electronic circuit of the watch, and can therefore be corrected during the initialisation carried out following replacement of the power source.

FIG. 3*f* shows the watch following replacement of the power source and after the time has been reset by the user. In order to reset the time, the user activates winding crown 36 so as to reset the time of his watch, here 3:30. In this time reset mode, the time value contained in time counter 8 is altered in synchronism with the movement of the hands, and this value therefore also corresponds to 3 hours and 30 minutes in this example.

Figure 1A:
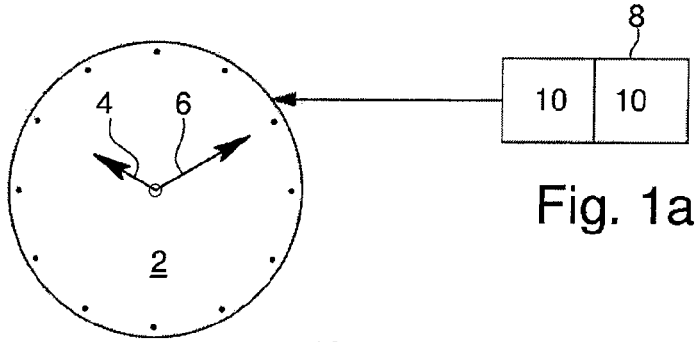
FIGS. 1*a* to 1*h* show the evolution of the analogue display means and the time counter value of a multi-function electronic watch according to the prior art, in particular, when the battery is being replaced.
Figure 1B:
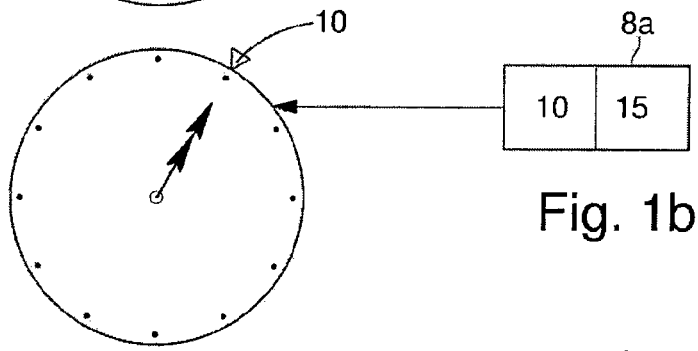
Figure 1C:
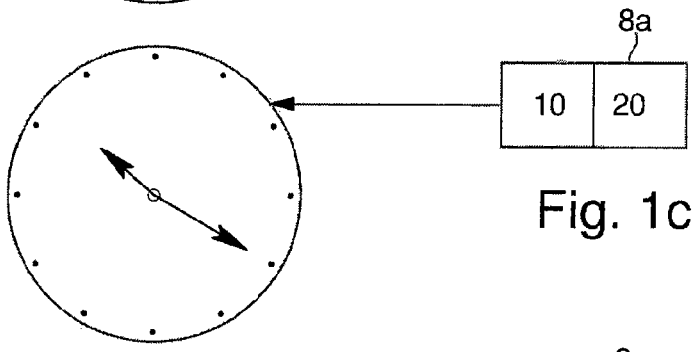
Figure 1D:
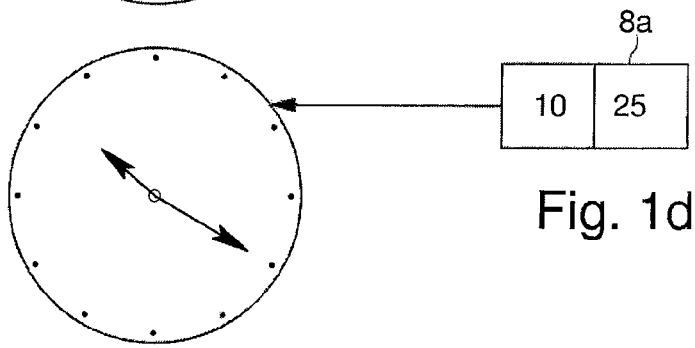
Figure 1E:
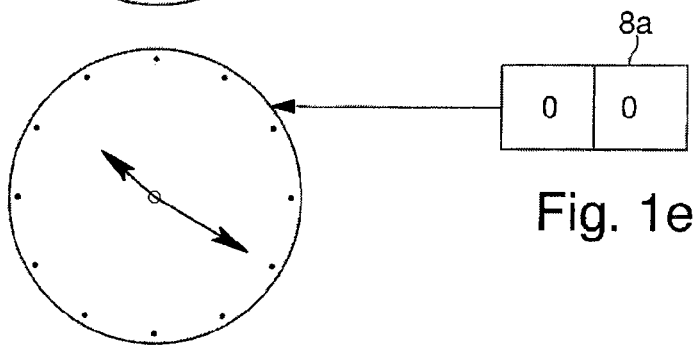
Figure 1F:
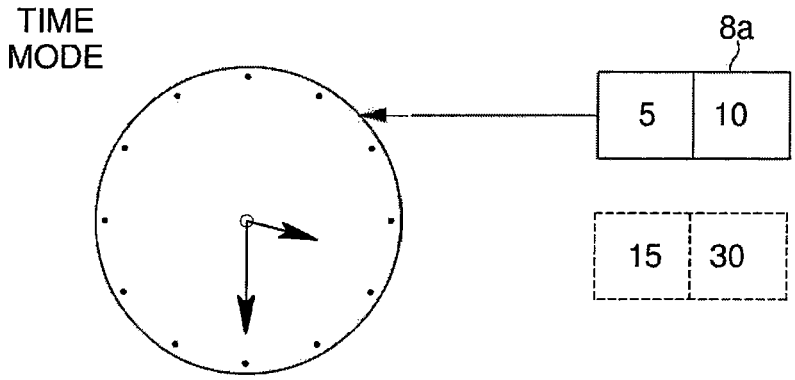
Figure 1G:
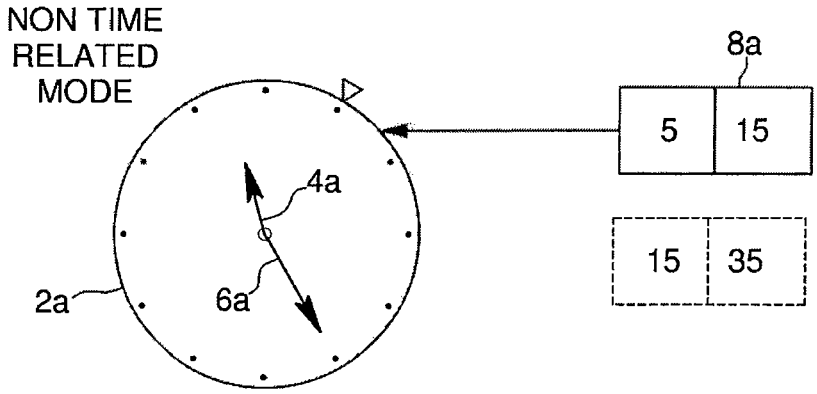
Figure 1H:
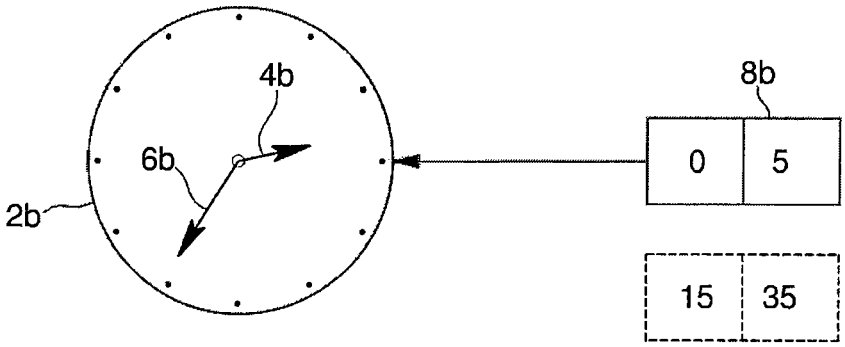

FIG. 3*g* shows the watch five minutes later, the time value of the counter is thus now 3 hours 35 minutes. Following activation of control member 26 by the user to select a non-time related mode of the watch, hands 4 and 6 have moved so as to indicate the predetermined reference value, in which both hands point to the first indicator corresponding to 1 o'clock, opposite additional indicator 10. The movement of hands 4 and 6 from the position that they occupied in time mode, i.e. 3:35 and this selected non-time mode reference position, is calculated by the difference calculating means of the watch. Since the counter value is still representative of the actual position of the hands in time mode, the latter have actually moved into the reference position of the selected non-time related mode, as shown, unlike the "fantasy" indications obtained with a solution of the prior art (see in particular FIG. 1*g*). The correct position of the hands can be achieved simply by moving the hands independently of each other by means of their respective motor, since the electronic circuit of the watch knows the start position of the hands defined by the value in the time counter and the end position of the hands, the latter being predetermined for the selected non-time related mode. During operation in non-time related mode, the counter value continues to be incremented by the time base, with the hands then no longer being moved in synchronism with the incrementation of the counter value. Thus, the user knows that his watch is in the non-time related mode corresponding to indicator 10, as the hands are pointing in that direction. Next, the watch can return to time mode as is explained with reference to FIG. 3*c*.

The invention thus concerns a method of synchronisation between analogue display means 4, 6 and the volatile time counter 8 during replacement of primary power means 18, which includes the following steps: (i) calculating a value representative (Vtps) of a time information item by means of the time base (14) of the watch; (ii) storing the value in the volatile time counter; (iii) updating the value in the volatile time counter periodically as a function of the supply frequency of a time information item by the time base; (iv) synchronized display of the value representative of a time information item by the analogue display means in a first operating mode of the watch; (v) non-synchronized display of a value not representative of a time information item by the analogue display means in a second operating mode of the watch; (vi) detecting the end of life of the primary power means powering the watch; (vii) setting the analogue display means in a predetermined reference position following detection of the end of life of the primary powering means; (viii) setting the value of the time counter to a predetermined reference value when the primary powering means are removed; (ix) automatic synchronisation between the analogue display means and the value of the time counter when the primary powering means are replaced.

FIG. 4 shows a time counter used in accordance with a preferred implementation of the synchronisation method according to the invention. Time counter 8 then includes three zones 81, 82 and 83. Central zone 82 contains the time value Vtps representative of an item of time information and of the position of the hands in the time mode of the watch. The counter further includes at least one protected zone, two 81 and 83 in the example shown, each containing a predetermined fixed value Vp1, Vp2. It is advantageous to check whether these values have been altered after the electronic circuit has been reset to zero, which can occur for various reasons, like for example an electrostatic discharge (ESD).

Because of the volatile nature of the counter, it is therefore important to ensure that the value that the latter contains has not been corrupted following a zero reset of the electronic circuit. If the values Vp1 and Vp2 have not been altered, the time counter value is almost certainly also unchanged. The electronic circuit of the watch then validates the time value as being still correct, i.e. representative of the actual position of the hands. Thus, the hands are still synchronized with the time value, and thus no synchronisation is necessary. This check has the advantage of being able to conceal from the user undesired zero resets of the electronic circuit that have not corrupted the time value, without any prejudice to the proper operation of the watch. Conversely, if one of the fixed values Vp1 or Vp2 has been altered, the time counter value may have been corrupted. It is therefore necessary in such case to synchronize the hands manually.

Thus, according to the preferred implementation of the previously described synchronisation method, for which the watch includes a protected volatile memory zone including at least one fixed data zone (81, 83) and one variable data zone (82), the method further comprising the following steps: (x) storing the value (Vtps) representative of an item of time information in the variable data zone (82); (xi) detecting a zero reset of the electronic circuit of the watch; (xii) subsequently checking whether at least one part of the data (Vp1, Vp2) of the fixed data zone (81, 83) has been altered; (xiii) if there is no alteration to the fixed data zone, validating the value representative of an item of time information as being correct.

It will be noted that the protected volatile memory zone preferably includes two predefined fixed data zones (81, 83) arranged on either side of the variable data zone (82). Moreover, it will also be noted that the time counter preferably corresponds to the protected volatile memory zone. In such case, steps (ii) and (x) are one and the same. Alternatively, the protected volatile memory zone could be distinct from the time counter and in such case the step of storing the value representative of an item of time information in the protected volatile memory zone is carried out at a lower frequency than the frequency for updating the value in the time counter.

It will be understood that various alterations and/or improvements obvious to those skilled in the art can be made to the synchronisation method according to the invention described above without departing from the scope of the invention defined by the annexed claims. In particular, one could envisage using a rechargeable power source instead of the primary power source. In such case, the step of detecting the end of life of the power source is replaced by a step of detecting insufficient power, the step of setting the time counter value to a predetermined reference value is carried out after detection of insufficient power and the automatic synchronisation step between the analogue display means and the time counter value is carried out after the rechargeable power source has been recharged to a predetermined voltage threshold higher than the threshold defined for detecting insufficient power.

The invention claimed is:

1. A synchronization method between an analogue display means and a volatile time counter in a multi-function electronic watch when a primary powering means powering the watch are replaced, wherein the watch includes a protected volatile memory zone including at least one fixed data zone and one variable data zone, the method including the following steps:

(i) calculating a value representative of a time information item by means of a time base of the watch;

(ii) storing the value in the volatile time counter;

(iii) updating the value in the volatile time counter periodically as a function of the supply frequency of the time information item by the time base;

(iv) synchronised display of the value representative of the time information item by the analogue display means in a first operating mode of the watch;

(v) non-synchronised display of a value not representative of the time information item by the analogue display means in a second operating mode of the watch;

(vi) detecting an end of life of the primary power means powering the watch;

(vii) setting the analogue display means to a predetermined reference position following detection of the end of life of the primary powering means;

(viii) setting the value of the volatile time counter to a predetermined reference value when the primary powering means are removed;

(ix) automatic synchronization between the analogue display means and the value of the volatile time counter when the primary powering means are replaced;

(x) storing the value representative of the time information item in the variable data zone;

(xi) detecting a zero reset of the electronic circuit of the watch;

(xii) subsequently checking whether at least one part of the data of the fixed data zone has been altered; and (xiii) if there is no alteration to the fixed data zone, validating the value representative of the time information item as being correct.

2. The synchronization method according to claim 1, wherein said protected volatile memory zone includes two predefined fixed data zones arranged on either side of the variable data zone.

3. The synchronization method according to claim 1, wherein the volatile time counter corresponds to said protected volatile memory zone.

4. The synchronization method according to claim 1, wherein the protected volatile memory zone is distinct from the volatile time counter and wherein the step of storing the value representative of the time information item in said protected volatile memory zone is carried out a frequency lower than the frequency for updating said value in said volatile time counter.

5. The synchronization method according to claim 1, wherein the watch includes a third manually activated operating mode or time reset mode of the analogue display means wherein the volatile time counter value is altered in synchronism with activation of the analogue display means.

6. An electronic watch, capable of being powered by a primary powering means, comprising:

a protected volatile memory zone including at least one fixed data zone and one variable data zone;

a volatile time counter capable of storing a value representative of a time information item;

a time base capable of generating a supply frequency of the time information item;

the volatile time counter further capable of being updated periodically as a function of the supply frequency of the time information item by the time base;

an analog display;

a synchronizer capable of adjusting the analog display to indicate the time information item during a first operating mode of the watch;

means for setting the analog display to indicate a value not representative of the time information item during a second operating mode of the watch;

a detector capable of anticipating a predicted end of life of the primary power means powering the watch and generating a signal;

means for setting the analogue display to a predetermined reference position in response to the signal from the detector; and means for setting the volatile time counter to a predetermined reference value in response to removal of the primary powering means.

7. The apparatus of claim 6, further comprising:

means for storing the value representative of the time information item in the variable data zone;

means for detecting a zero reset of the electronic circuit of the watch;

a comparator capable of checking whether at least one part of the data of the fixed data zone has been altered in response to detection of the zero reset, and capable of generating a signal indicating no detectable change;

means for validating the value representative of the time information item as being correct in response to the signal received from the comparator.

* * * * *